US005167341A

United States Patent [19]

Morton et al.

[11] Patent Number: 5,167,341

[45] Date of Patent: Dec. 1, 1992

[54] LID ASSEMBLY FOR ROLL-OFF SLUDGE CONTAINERS

[75] Inventors: Jamie S. Morton; Corwin H. Hanks, both of Oklahoma City; Roger R. Lindley, Yukon; Neal B. Flowers, Blanchard, all of Okla.

[73] Assignee: McClain Industries of Oklahoma, a division of McClain Industries, Inc., Oklahoma City, Okla.

[21] Appl. No.: 829,924

[22] Filed: Feb. 3, 1992

[51] Int. Cl.[5] ..... B65D 43/20

[52] U.S. Cl. ..... 220/346; 220/349; 220/1.5; 220/908; 49/33; 49/127; 52/66; 52/67; 105/377

[58] Field of Search ..... 220/345, 346, 349, 908, 220/347, 348, 1.5, 324; 49/33, 127, 422; 52/66, 67; 105/377

[56] References Cited

U.S. PATENT DOCUMENTS

| | | | |
|---|---|---|---|
| 555,971 | 3/1896 | Richards | 105/377 |
| 571,577 | 11/1896 | Richards | 105/377 |
| 1,015,146 | 1/1912 | Davis et al. | 105/377 |
| 1,193,347 | 8/1916 | Bauer | 220/345 |
| 1,414,783 | 5/1922 | Lieniz | 49/127 |
| 3,526,194 | 9/1970 | Schneider et al. | 105/377 |
| 3,540,771 | 11/1970 | Stoneburner | 105/377 X |
| 3,999,489 | 12/1976 | Kramer et al. | 49/127 |
| 4,616,451 | 10/1986 | Glick | 52/66 |
| 4,653,662 | 3/1987 | Wise et al. | 220/345 |
| 4,659,136 | 4/1987 | Martin et al. | 105/377 X |
| 4,762,242 | 8/1988 | Harris et al. | 220/345 X |
| 4,787,119 | 11/1988 | Faruya | 49/127 |
| 4,934,562 | 6/1990 | Early et al. | 220/1.5 |
| 4,941,581 | 7/1990 | Searles et al. | 220/1.5 |
| 4,960,150 | 10/1990 | Ryan | 220/345 X |
| 4,974,898 | 12/1990 | Baranski | 220/345 X |

FOREIGN PATENT DOCUMENTS

| | | | |
|---|---|---|---|
| 229356 | 9/1963 | Austria | 105/377 |

*Primary Examiner*—Stephen Marcus
*Assistant Examiner*—Stephen Cronin
*Attorney, Agent, or Firm*—Glen M. Burdick; Bill D. McCarthy

[57] ABSTRACT

An immproved lid assembly for roll-off sludge containers is provided wherein the lid assembly is supported by oppositely disposed lip portions which extend longitudinally along each side of an opening formed in an upper side of the sludge container. The lid assembly comprises a plurality of lid members and a roller assembly connected to each of the lid members so that the lid members can be selectively moved between a first position and a second position relative to the opening of the sludge container. In the first position the lid members are telescopically disposed in adjacent lid members, thus providing access to selected portions of the opening in the sludge container. In the second position, the lid members are extended and close off the opening in the sludge container.

14 Claims, 5 Drawing Sheets

LID ASSEMBLY FOR ROLL-OFF SLUDGE CONTAINERS

BACKGROUND OF THE INVENTION

1. Field of the Invention

The present invention relates to sludge containers, and more particularly, but not by way of limitation, to an improved lid assembly for a roll-off sludge container.

2. Brief Description of the Prior Art

Roll-off sludge containers have heretofore found wide use in the transportation of sludge from a point of origin to a location for disposal. During transportation of sludge, it is necessary to effectively seal the sludge containers to prevent spillage. Because sludge is normally transported by rail, the amount of clearance required above the sludge containers must be maintained at a minimum.

While lid assemblies for sludge containers have heretofore been known, problems nevertheless exist due to the excessive amount of clearance often required above a container for the lid assembly to assure an effective seal for the container. Further, it is often difficult for workmen to secure the lid assembly on the container, or to position the lid assembly during loading and unloading of sludge. Thus, a new and improved lid assembly for a sludge container wherein the amount of clearance required above the sludge container is maintained at a minimum is desired. Further, such a lid assembly should desirably be easily secured in a stable position on a sludge container for transportation, while at the same time permitting the operator to more easily move the lid assembly so that selected portions of the sludge container are available for receipt or removal of sludge. It is to such an improved lid assembly that the present invention is directed.

SUMMARY OF THE INVENTION

According to the present invention an improved lid assembly for roll-off sludge containers is provided wherein the lid assembly is supported by oppositely disposed lip portions which extend longitudinally along each side of an opening formed in an upper side of the sludge container. The improved lid assembly comprises a plurality of lid members and a roller assembly connected to each of the lid members so that the lid members can be selectively moved between a first position and a second position relative to the opening of the sludge container. In the first position the lid members are telescopically disposed in adjacent lid members, thus providing access to selected portions of the opening in the sludge container. In the second position, the lid members are extended and close off the opening in the sludge container.

The roller assemblies are connected to each of the lid members so as to permit individual movement of the lid members. Each of the roller assemblies is selectively movable between an extended travel position and a retracted position. The roller assemblies are biased in the extended travel position so as to provide movement of the supporting lid members between the first and second positions in response to travel of the roller assemblies along a travel path on the container. In the retracted position, the roller assemblies extend upwardly into the supporting lid members so that the lid members can be secured to the sludge container. Further, the roller assemblies for each lid member are laterally displaced relative to the roller assemblies of the remaining lid members in order to enhance movement of the lid members between the first and second positions.

The improved lid assembly of the present invention further comprises a connector assembly for securing the lid members to the sludge container, and a gasket for forming a fluid-tight seal between the lid members and the sludge container. In order to provide a fluid-tight seal between each lid member, an end portion of each of the lid members is disposed within an end portion of an adjacent lid member when the lid members are in the second position. Thus, the gasket is disposed between adjacent lid members, as well as between each of the lid members and the container, so that an effective seal is formed therebetween when the lid members are secured to the container in the second position.

An object of the present invention is to provide an improved lid assembly for a sludge container wherein the amount of clearance required above the sludge container is maintained at a minimum.

Another object of the present invention, while achieving the before-stated object, is to provide an improved lid assembly for a roll-off sludge container which permits access to any portion of a sludge chamber of the sludge container.

Yet another object of the present invention, while achieving the before-stated objects, is to provide an improved lid assembly for roll-off sludge containers which is durable in construction, economical to manufacture, and which overcomes many of the disadvantages of the prior art lid assemblies for such roll-off sludge containers.

Other objects, features and advantages of the present invention will become clear upon reading the following detailed description in conjunction with the drawings and the appended claims.

BRIEF DESCRIPTION OF THE DRAWINGS

FIG. 6 is a bottom plan view of the lid member of FIG. 4A illustrating the pivotal attachment of a plurality of roller assemblies to the lid member.

DETAILED DESCRIPTION

Figure 1:
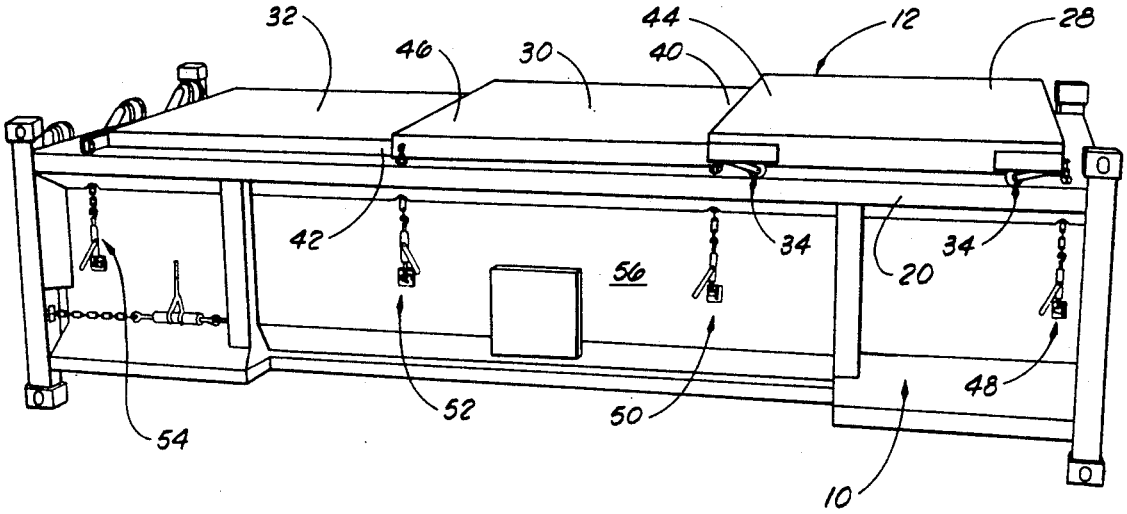
FIG. 1 is a perspective view of a sludge container having an improved lid assembly of the present invention secured thereto, the lid assembly disposed in an extended container closing position.
Figure 2:
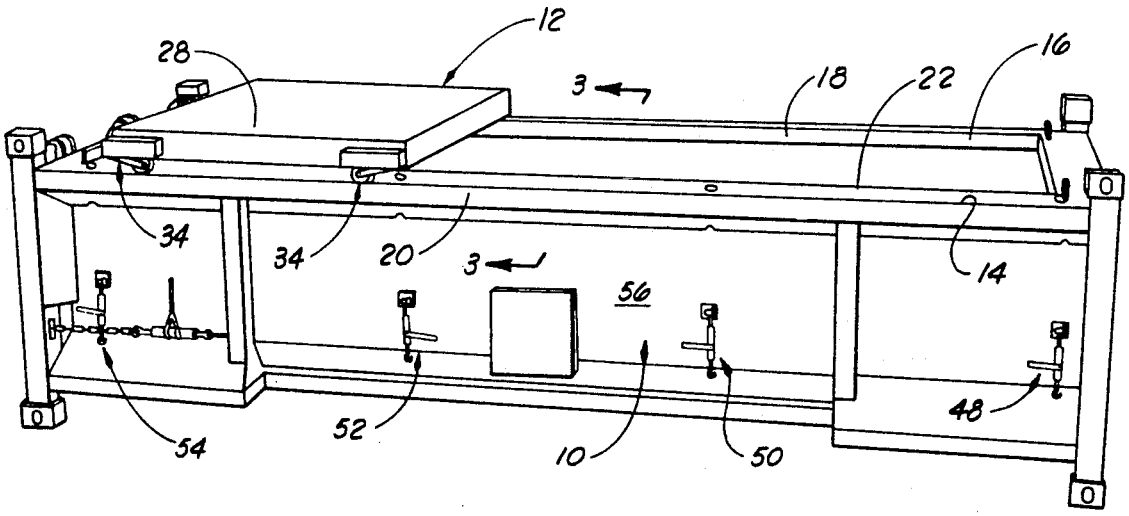
FIG. 2 is a perspective view of a sludge container having the improved lid assembly of the present invention, the lid assembly disposed in a retracted position so as to provide access to a sludge chamber of the sludge container.

Referring now to the drawings, and more particularly to FIGS. 1 and 2, a sludge container 10 having an improved lid assembly 12 of the present invention supported thereon is illustrated. The sludge container 10 is a conventional container known in the art as a roll-off or roll-off intermodal sludge container.

Figure 3:
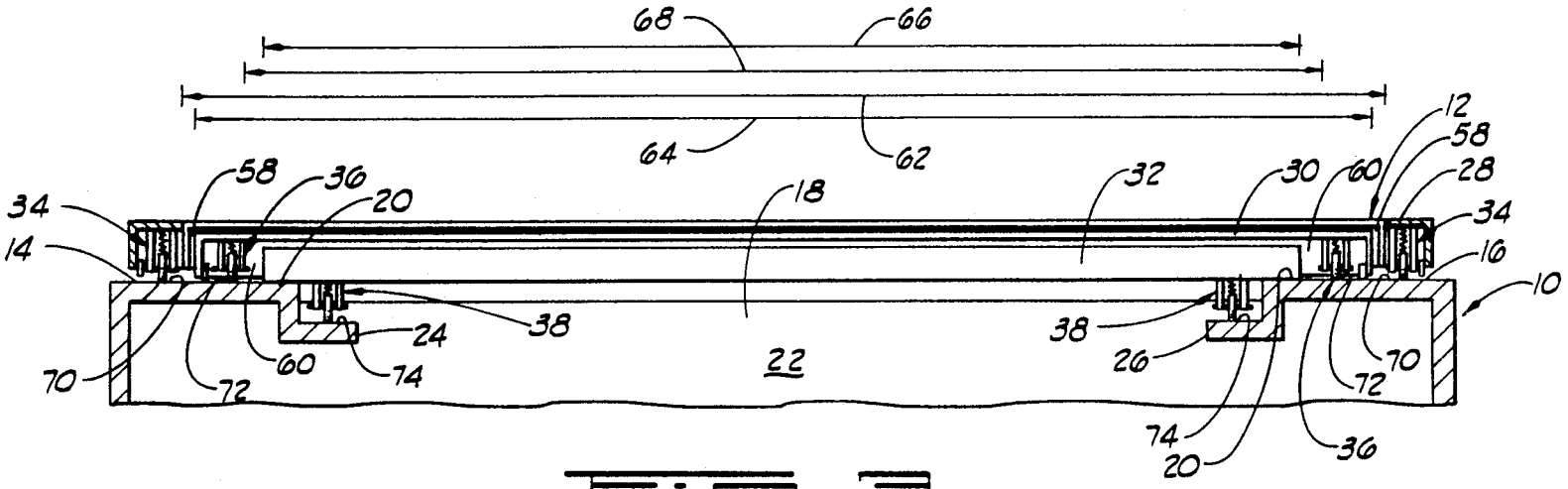
FIG. 3 is a partially cut away view of a sludge container having the improved lid assembly of the present invention taken along 3—3 of FIG. 2.

As more clearly shown in FIGS. 2 and 3, the container 10 is provided with oppositely disposed lip portions 14, 16 extending longitudinally along each side of an opening 18 formed through an upper side 20 of the sludge container 10. The opening 18 communicates with a sludge chamber 22 formed in the sludge container 10; and the lip portions 14, 16 are provided with recessed ledges 24, 26, respectively, disposed adjacent the opening 18 substantially as shown in FIG. 3.

The lid assembly 12 comprises a plurality of lid members 28, 30 and 32, and a plurality of roller assemblies 34, 36 and 38. The roller assemblies 34, 36 and 38 are connected to the lid members 28, 30, and 32, respectively, so that the lid members 28, 30 and 32 can be selectively moved along travel paths on the lip portions 14, 16 and the recessed ledges 24, 26 of the sludge container 10. That is, the lid members 28, 30 and 32 can be selectively moved along the lip portions 14, 16 and the recessed ledges 24, 26 of the sludge container 10 between a first position (FIG. 1) and a second position (FIG. 2). In a first position, one or more of the lid members, such as lid members 30 and 32, are telescopically disposed in another lid member, such as lid member 28, so as to provide access to the sludge chamber 22 of the sludge container 10 via the opening 18. However, in the second position, the lid members 28, 30 and 32 cooperate to close off the opening 18 in the sludge container 10.

As will be described in more detail hereinafter, when the lid members 28, 30 and 32 are in the second position, an end portion (such as end portions 40 and 42 of the lid members 30 and 32) is disposed within an end portion of an adjacent lid member (such as the adjacently disposed end portions 44, 46 of the lid members 28, 30, respectively), substantially as shown in FIG. 1. Thus, when the lid members 28, 30 and 32 are secured to the container 10 in the second position, an effective seal is formed between each of lid members 28, 30 and 32 and the container 10.

Any suitable lock assembly can be employed to secure the lid members 28, 30 and 32 to the container 10 when the lid members 28, 30 and 32 are disposed in the second position. For example, the container 10 can be provided with a plurality of ratchet-type lock assemblies (such as ratchet-type lock assemblies 48, 50, 52 and 54 positioned along side 56 of container 10) capable of engaging the lid members 28, 30 and 32 so that an effective seal is provided therebetween and between the lip portions 14, 16 of the container 10 and the lid members 28, 30 and 32. The ratchet-type lock assemblies, such as the lock assemblies 48–54, secure the lid members 28, 30 and 32 to the container 10 when the lid members 28, 30 and 32 are in the second position, substantially as shown in FIG. 1.

Ratchet-type lock assemblies are well known in the art, as is their use to connect lid members to containers. Thus, no further description of such ratchet-type lock assemblies is believed necessary in order to permit one skilled in the art to understand and practice the inventive concept relating to the lid assemblies for sludge containers of the present invention.

Referring now more specifically to FIG. 3, the interaction between the lid members 28, 30 and 32, which permits each of the lid members 28, 30 and 32 to be selectively moved between the first and second positions, is illustrated. The lid member 28 is provided with a lid receiving cavity 58 adapted to telescopically receive the lid member 30; and the lid member 30 is provided with a lid receiving cavity 60 adapted to telescopically receive the lid member 32. That is, the lid receiving cavity 58 of the lid member 28 is provided with an effective width 62 which is greater than a width 64 of the lid member 30; and the lid receiving cavity 60 of the lid member 30 is provided with an effective width 66 which is greater than a width 68 of the lid member 32. Thus, the lid member 32 can be telescopically disposed within the lid receiving cavity 60 of the lid member 30 and the lid member 30 can be telescopically disposed within the lid receiving cavity 58 of the lid member 28 when the lid members 28, 30 and 32 are selectively moved along the upper side 20 of the container 10 to provide access to any portion of the opening 18 of the container 10, and thus the sludge chamber 22.

To facilitate movement of the lid members 28, 30 and 32 between the first and second positions on the container 10, the roller assemblies 34, 36 and 38 of the lid members 28, 30 and 32, respectively, are laterally displaced relative to one another so that the roller assemblies 34, 36 and 38 travel along different travel paths provided on the lip portions 14, 16 and the recessed ledges 24, 26 of the container 10. That is, the roller assemblies 34 are connected to the lid member 28 so that the roller assemblies 34 travel along a first or outer disposed travel path 70 on the lip portions 14, 16 of the container 10 when the lid member 28 is selectively moved between the first and second positions; whereas, the roller assemblies 36 are connected to the lid member 30 so that the roller assemblies 36 travel along a second or inner disposed travel path 72 on the lip portions 14, 16 of the container 10 when the lid member 30 is selectively moved between the first and second positions.

The roller assemblies 38 are connected to the lid member 32 so that the roller assemblies 38 travel along a third travel path 74 on the recessed ledges 24, 26 of the container 10 when the lid member 32 is selectively moved between the first and second positions. By laterally displacing the roller assemblies 34, 36 and 38 of the lid members 28, 30 and 32, respectively, the lid members 28, 30 and 32 can be selectively moved between the first and second positions independent of movement of the other lid members.

Figure 4A:
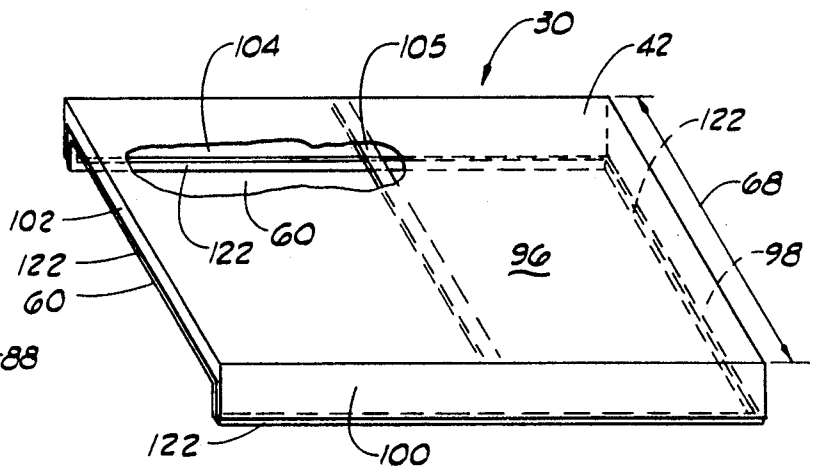
FIG. 4A is a partially cut away perspective view of a lid member of the improved lid assembly of the present invention having roller assemblies removed therefrom for clarity.

Referring now to FIGS. 4A and 6, the lid member 28 comprises an upper member 76 and peripherally disposed sealing lips 78, 80, 82 and 84. The lid receiving cavity 58 of the lid member 28 is defined by the upper member 76 and the sealing lips 78, 80, 82 and 84. The sealing lip 82 is provided with a height less than the height of the sealing lips 78, 80 and 84. Thus, the end portion 40 of the lid member 30 is disposed within the lid receiving cavity 58 of the lid member 28 so as to be in an underlying position when the lid members 28 and 30 are in the second position; and the lid member 28 telescopically receives the lid member 30 within the lid receiving cavity 58 when the lid members 28, 30 are moved to the first position to provide access to the opening 18 in the sludge container 10. That is, the sealing lip 82 is dimensioned so as to permit the end portion 40 of the lid member 30 to be maintained in an under-disposed position relative to the lid member 28 when the lid members 28, 30 are in the second position (FIG. 1) while permitting the lid member 30 to be slidably disposed within the lid receiving cavity 58 of the lid member 28 when the lid members 28, 30 are moved to the first position (FIG. 2).

In order to provide the desired lateral displacement of the roller assemblies 34 of the lid member 28 relative to the roller assemblies 36, 38 of the lid members 30, 32, respectively, the lid member 28 further comprises a plurality of roller assembly housings 88, 90, 92 and 94 connected to the lid member 28 so as to extend outwardly therefrom substantially as shown. That is, the roller assembly housings 88, 90 are connected to the sealing lip 80 of the lid member 28 so as to be disposed at opposite ends thereof; and the roller assembly housings 92, 94 are connected to the sealing lip 84 of the lid member 28 so as to be disposed at opposite ends thereof.

One roller assembly 34 is disposed within each of the roller assembly housings 88, 90, 92 and 94, substantially as shown in FIG. 6; and each of the roller assemblies 34 is pivotally connected to the adjacently disposed sealing lips 80 and 84 of the lid member 28 and its respective roller assembly housing so that the roller assemblies 34 can be selectively moved between an extended travel position (FIGS. 2 and 3) and a retracted position. In the retracted position, the roller assemblies 34 are retracted in the supporting roller assembly housings 88, 90, 92 and 94 so that the lid member 28 can be secured in the second position by the ratchet-type lock assemblies 48 and 50 (FIG. 1).

The roller assemblies 34, which will be discussed in detail hereinafter, are biased in the extended travel position so that when the lid member 28 is in a non-secured position, the lid member 28 is supported a selected distance above the upper side 20 of the container 10 by the roller assemblies 34. Thus, the lid member 28 can be readily moved along the upper side 20 of the container 10 in response to travel of the roller assemblies 34 along the first travel path 70 on the lip portions 14, 16 of the container 10, so that the lid members 30 and 32 can be telescopically disposed within the lid receiving cavity 58 of the lid member 28.

To enhance the structural integrity of the lid member 28, the lid member 28 can be provided with one or more brace members, such as a brace member 95. However, when employing the brace member 95, care must be exercised to insure that the brace member 95 does not interfere with the telescopic disposition of the lid member 30 into the lid receiving cavity 58 of the id member 28.

Figure 4B:
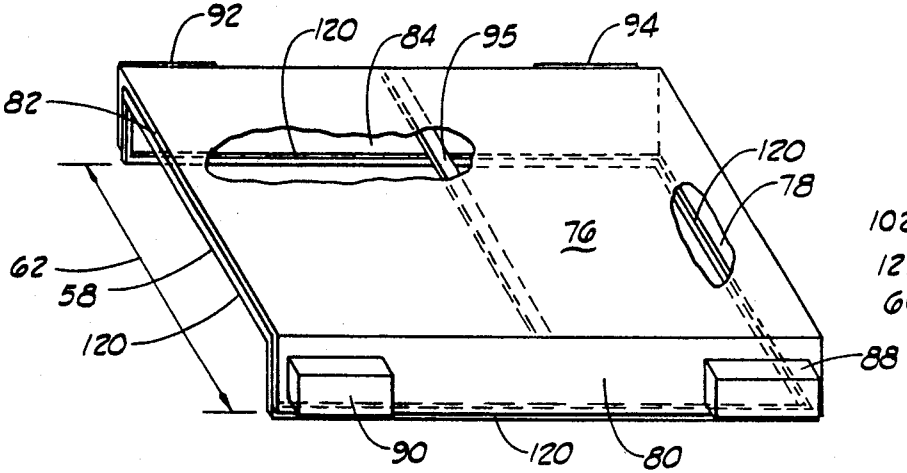
FIG. 4B is a partially cut away, perspective view of a second lid member of the improved lid assembly of the present invention also having roller assemblies removed therefrom for clarity.
Figure 7:
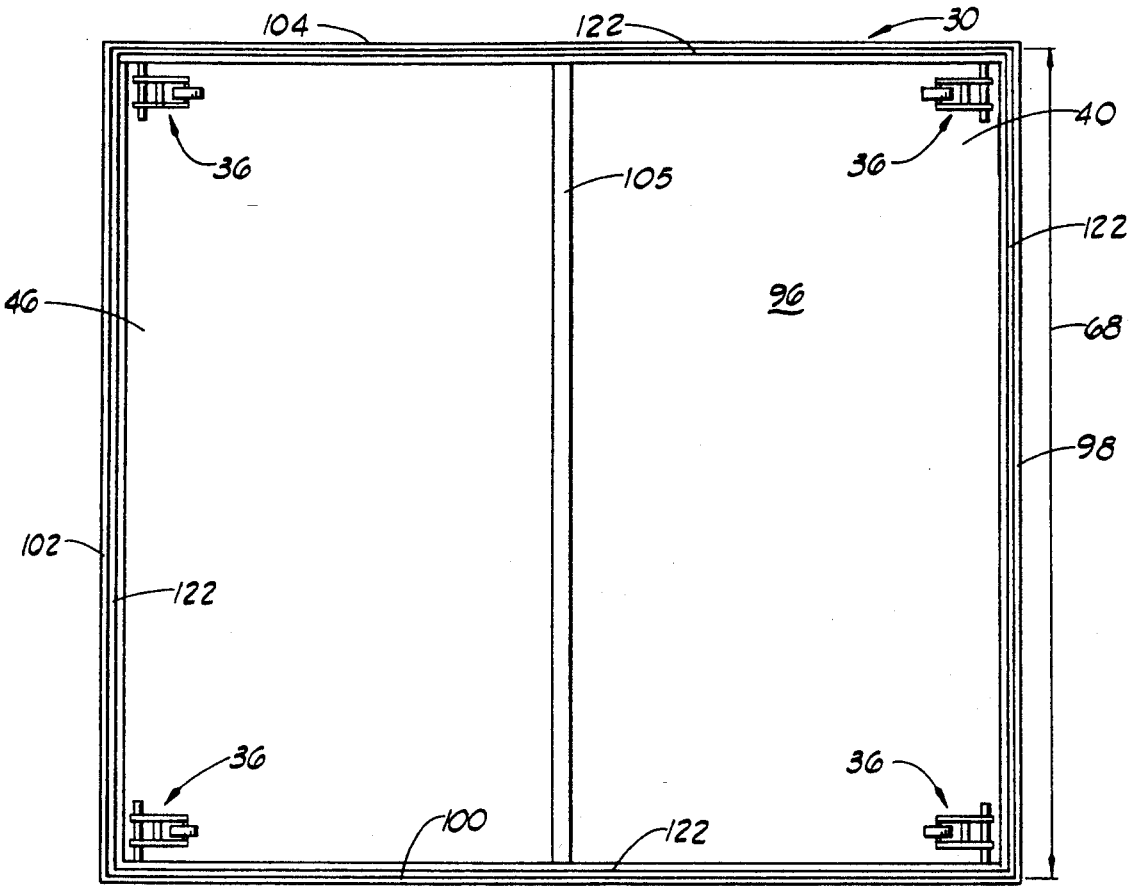
FIG. 7 is a bottom plan view of the lid member of FIG. 4B illustrating the pivotal attachment of a plurality of roller assemblies to the lid member.

Referring now to FIGS. 4B and 7, the lid member 30 comprises an upper member 96 and peripherally disposed sealing lips 98, 100, 102 and 104. The lid receiving cavity 60 of the lid member 30 is defined by the upper member 96 and the sealing lips 98, 100, 102 and 104. The sealing lip 102 is provided with a height less than the sealing lips 98, 100 and 104; and the sealing lips 98, 100 and 104 are provided with a height less than the height of the sealing lips 78, 80 and 84 of the lid member 28. Thus, the lid member 30 can be telescopically disposed within the lid receiving cavity 58 of the lid member 28, as heretofore described. Further, the end portion 42 of the lid member 32 (which is provided with an effective width 68 less than the width 66 of the lid receiving cavity 60 of the lid member 30) is disposed within the lid receiving cavity 60 of the lid member 30 so as to be in an underlying position when the lid members 30 and 32 are in the second position (FIG. 1); and the lid member 30 telescopically receives the lid member 32 within the lid receiving cavity 60 when the lid members 30, 32 are moved to the first position to provide access to a portion of the opening 18 in the sludge container 10 (FIG. 2). That is, the sealing lip 102 is dimensioned so as to permit the end portion 42 of the lid member 32 to be maintained in an under-disposed position relative to the lid member 30 when the lid members 30, 32 are in the second position, while permitting the lid member 32 to be slidably disposed within the lid receiving cavity 60 of the lid member 30 when the lid members 30, 32 are moved to the first position.

The roller assemblies 36 are pivotally connected to each end portion of the sealing lips 100, 104 so as to be disposed within the lid receiving cavity 60 of the lid member 30, substantially as shown in FIG. 7; and the roller assemblies 36 are biased in the extended travel position so that when the lid member 30 is in a non-secured position, the lid member 30 is supported a selected distance above the upper side 20 of the container 10 by the roller assemblies 36. Thus, the lid member 30 can be readily moved along the upper side 20 of the container 10 in response to travel of the roller assemblies 36 along the second travel path 72 on the lip portions 14 and 16 of the container 10, so that the lid member 30 can be telescopically disposed within the lid receiving cavity 58 of the lid member 28 and/or the lid member 32 can be telescopically disposed within the lid receiving cavity 60 of the lid member 30.

To enhance the structural integrity of the lid member 30, the lid member 30 can be provided with one or more brace members, such as a brace member 105. However, when employing the brace member 105, care must be exercised to insure that the brace member 105 does not interfere with the telescopic disposition of the lid member 32 into the lid receiving cavity 60 of the lid member 30.

Figure 4C:
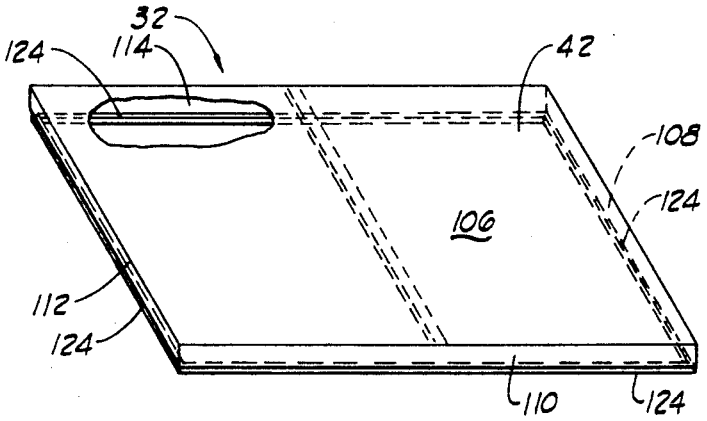
FIG. 4C is a partially cutaway perspective view of a third lid member of the improved lid assembly of the present invention also having roller assemblies removed therefrom for clarity.
Figure 8:
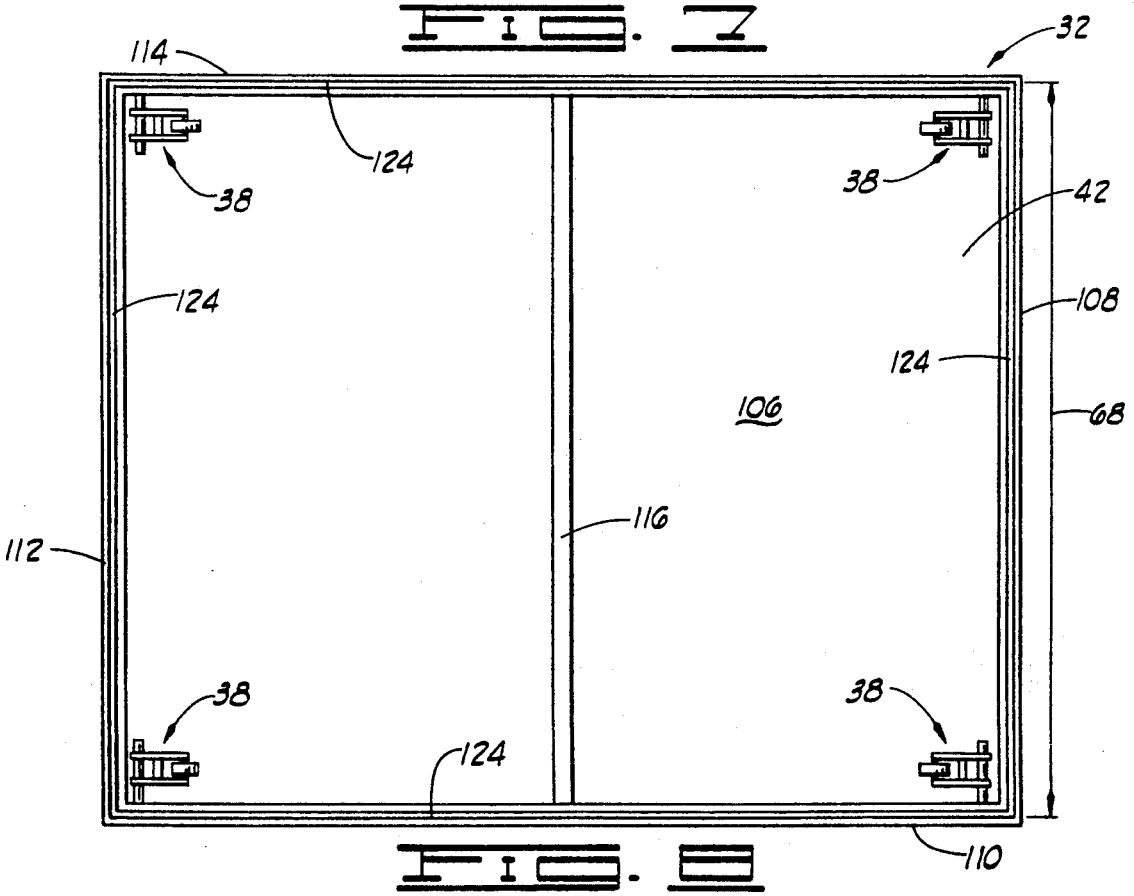
FIG. 8 is a bottom plan view of the lid member of FIG. 4C illustrating the pivotal attachment of a plurality of roller assemblies to the lid member.

Referring now to FIGS. 4C and 8, the lid member 32 comprises an upper member 106 and peripherally disposed sealing lips 108, 110, 112 and 114. The lid member 32 is substantially identical in construction to the lid member 30 except that each of the sealing lips 108, 110, 112 and 114 can be of the same height, and the width 66 of the lid member 32 is less than the width 68 of the lid receiving cavity 60 of the lid member 30. Further, the sealing lips 108, 110, 112 and 114 of the lid member 32 are provided with a height less than the height of the sealing lips 98, 100, 102 and 104 of the lid member 30. Thus, the end portion 42 of the lid member 32 can be disposed in an underlying relationship relative to the lid member 30 when the lid members 30, 32 are in the first position (FIG. 1), and the lid member 32 can be slidably disposed within the lid receiving cavity 60 of the lid member 30 when the lid members 30, 32 are moved to the second position.

The roller assemblies 38 are pivotally connected to the end portions of the sealing lips 110 and 114 of the lid member 32 so as to be disposed within the lid member 32 substantially as shown in FIG. 8; and the roller assemblies 38 are biased in the extended travel position so that when the lid member 32 is in a non-secured position, the lid member 32 is supported a selected distance above the upper side 20 of the container 10 by the roller assemblies 38 (FIGS. 2 and 3). Thus, the lid member 32 can be readily moved along the upper side of the container 10 in response to travel of the roller assemblies 38 along the third travel path 74 on the recessed ledges 24, 26 of the container 10.

To enhance the structural integrity of the lid member 32, the lid member 32 can be provided with one or more brace members, such as a brace member 116. As illustrated, the brace member 116 extends between and is connected to the sealing lips 110 and 114.

In order to provide an effective seal between each of the lid members 28, 30 and 32 and between the lid members 28, 30 and 32 and the container 10 (when the lid members 28, 30 and 32 are in the second position and secured to the container 10, such as with the ratchet-type lock assemblies 48–54), the lid assembly 12 further comprises a plurality of gaskets 120, 122 and 124. The gaskets 120 are secured along an interior surface of the sealing lips 78, 80, 82 and 84 of the lid member 28; the gaskets 122 are secured along an interior surface of the sealing lips 98, 100, 102 and 104 of the lid member 30; and the gaskets 124 are secured along an interior surface of the sealing lips 108, 110, 112 and 114 of the lid member 32. The gaskets 120, 122 and 124 extend from each of the supporting lip portions of the lid members 28, 30 and 32 so that when the lid members 28, 30 and 32 are secured in the first position by connection of the ratchet-type lock assemblies as heretofore described, the gaskets 120, 122 and 124 cooperate to form an effective seal between the adjacently disposed lid member as well as the upper side 20 of the container 10. However, when the lid members 28, 30 and 32 are in a non-secured position, the gaskets 120, 122 and 124 are disposed a distance from the adjacent lid members 30, 32 and the upper side 20 of the container 10 so that the gaskets 120, 122 and 124 do not interfere with movement of lid members 28, 30 and 32 between the first and second positions.

Figure 5:
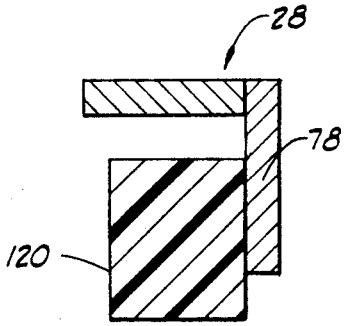
FIG. 5 is an enlarged, fragmental cross-sectional view illustrating a gasket supported by a sealing lip of the lid member of FIG. 4A.

Any suitable resilient material can be employed as the gaskets 120, 122 and 124. Further, since the connection of each of the gaskets 120, 122 and 124 to the sealing lips of the respective lid member 28, 30 and 32 is substantially identical, only the attachment of a portion of the gasket 120 to the sealing lip 78 of the lid member 28 is shown in detail in FIG. 5. Further, it should be noted that any suitable means, such as commercially available adhesives, rivets, and the like, can be employed for securing the gasket 120 to the sealing lip 78.

As previously stated, the roller assemblies 34 are pivotally connected to the lid member 28 so that one of the roller assemblies 34 is disposed within each of the roller assembly housings 88, 90, 92 and 94; the roller assemblies 36 are connected to the sealing lips 100, 104 of the lid member 30 so as to be disposed within the lid receiving cavity 60 of the lid member 30, substantially as shown in FIG. 7; and the roller assemblies 38 are connected to the sealing lips 110, 114 of the lid member 32 so that the roller assemblies 38 are disposed within the lid member 32, substantially as shown in FIG. 8. The roller assemblies 34, 36 and 38 are substantially identical in construction and function. Thus, only one of the roller assemblies 36 and its attachment to the sealing lip 104 of the lid member 30 will be described in detail hereinafter.

Figure 9:
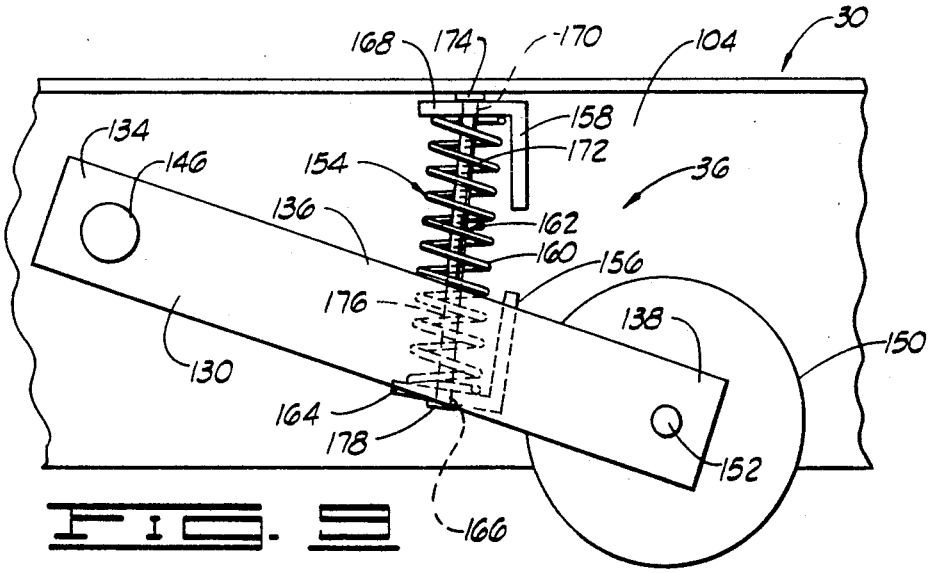
FIG. 9 is an enlarged side elevational view of a roller assembly of the improved lid assembly of the present invention.
Figure 10:
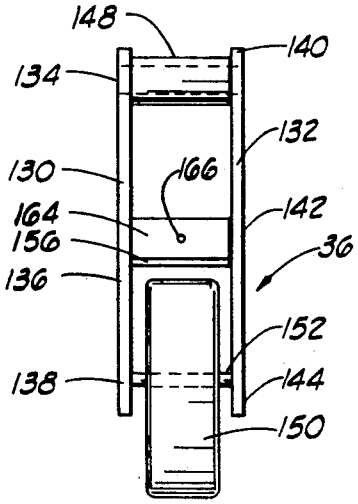
FIG. 10 is an end view of one of the roller assemblies of the improved lid assembly of the present invention wherein a biasing spring has been removed therefrom for clarity.
Figure 5:
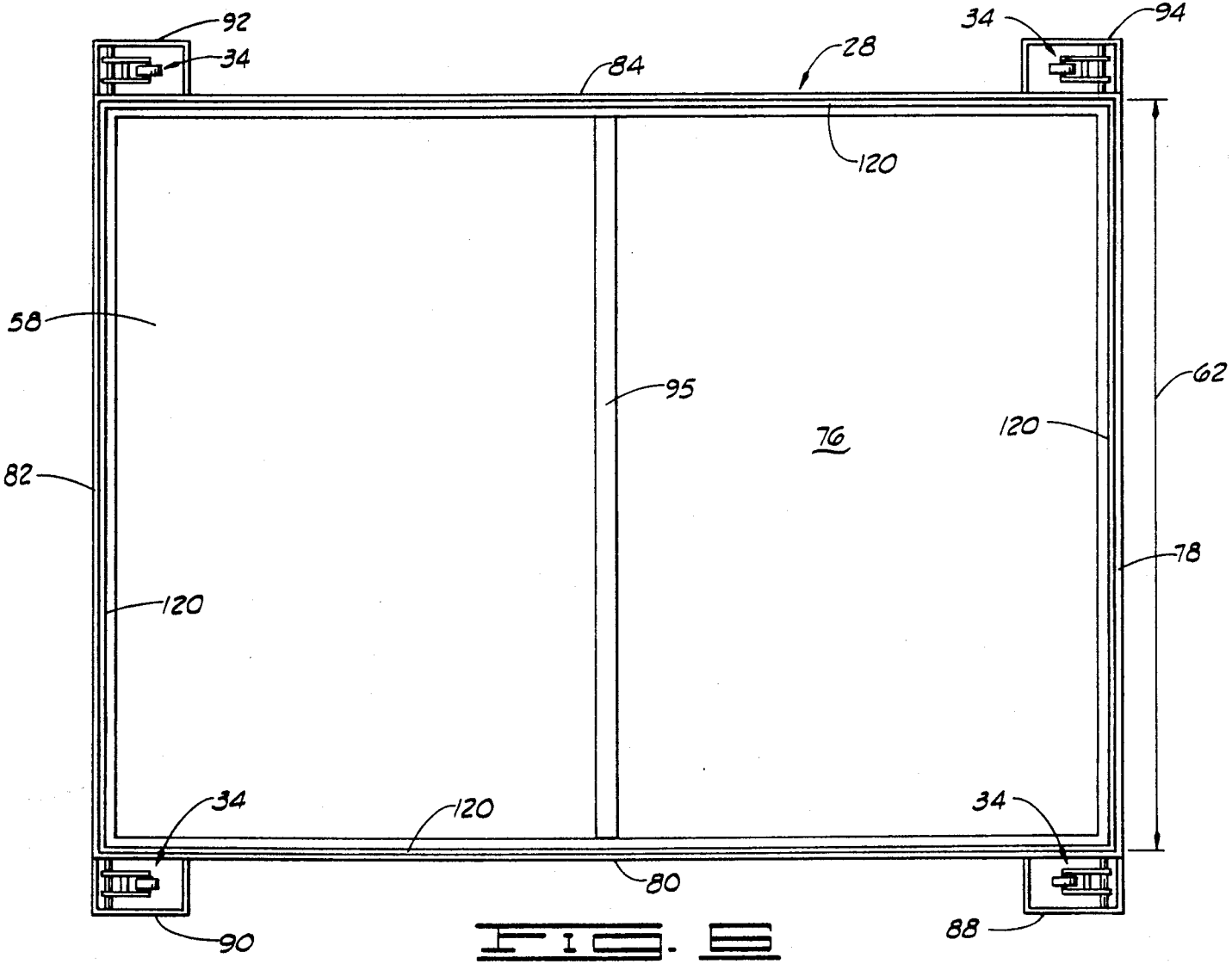

Referring now to FIGS. 9 and 10, the roller assembly 36 is provided with a first arm member 130 and a substantially parallel, spatially disposed arm member 132. The first arm member 130 is characterized as having a first end portion 134, a medial portion 136 and an opposed or distal end portion 138. Similarly, the second arm member 132 is characterized as having a first end portion 140, a medial portion 142 and an opposed or distal end portion 144. The arm members 130, 132 are pivotally connected via their respective first end portions 134, 140 to the sealing lip 104 of the lid member 30 by a pivot pin 146. In order to maintain the arm members 130, 132 in a desired parallel, spatial relationship, a spacer or bushing 148 is disposed between the first end portions 134, 140 of the arm members 130, 132, substantially as shown in FIG. 10.

A wheel member 150 is disposed between and journally connected to the distal end portions 138, 144 of the first and second arm members 130, 132 by any suitable means, such as an axle member 152. The roller assembly 36 further includes an adjustable spring assembly 154. The adjustable spring assembly 154 is disposed between the medial portions 136, 142 of the arm members 130, 132 and the upper member 96 of the lid member 30 and biases the wheel member 150 in the extended travel position so that the lid member 30 can be supported a selected distance above the lip portions 14, 16 of the container 10 when the lid member 30 is in the unsecured position (FIGS. 2 and 3).

As shown in FIG. 9, the adjustable spring assembly 154 comprises a first spring support member 156, a second spring support member 158, a spring 160 and an adjustable connector assembly 162. The first spring support member 156, a substantially L-shaped member, is disposed between and connected to the medial portions 136, 142 of the arm members 130, 132 so that the first spring support member 156 is spatially disposed and in close proximity to the wheel member 150. The second spring support member 158, an inverted, substantially L-shaped member, is connected to the sealing lip 104 of the lid member 30 so as to be substantially vertically aligned and spatially disposed from the first spring support member 156.

A substantially vertically disposed leg 164 of the first spring support member 156 is provided with a centrally disposed aperture 166 extending therethrough; and a substantially vertically disposed leg 168 of the second spring support member 158 is provided with a centrally disposed aperture 170 extending therethrough which is alignable with the aperture 166 of the vertically disposed leg 164 of the first spring support member 156.

The spring 160 is positioned between the first and second spring support members 156, 158 and secured in a stable position by the interconnection of the spring 160 to the first and second spring support members 156, 158 by the adjustable spring connector assembly 162. Further, the adjustable spring connector assembly 162, which will be described in more detail hereinafter, permits one to adjust the tension on the spring 160 in order to maintain the arm members 130, 132 (and thus the wheel member 150) in the extended travel position to enhance movement of the lid member 30 between the first and second positions along the container 10.

The adjustable connector assembly 162 comprises a bolt 172 having an enlarged head portion 174 and a threaded shank portion 176, and a lock nut 178. To connect the spring member 160 to the first and second spring support members 156, 158, the bolt 172 is positioned through the aperture 166 of the first spring support member 156, the spring 160 and the aperture 170 of the second spring support member 158 so that the enlarged head portion 174 abuttingly engages the leg 168 of the second spring support member 158. The threaded shank portion 178 extends through the spring 160 and the aperture 170 of the first spring support member 156. The lock nut 178 is secured to the threaded shank portion 176 of the bolt 172. Thus, when it is desirable to adjust the tension on the spring 160 in order to maintain the arm members 130, 132 and the wheel member 150 in the extended travel position, such adjustment can readily be achieved by altering the effective length of the threaded shank portion 176 of the bolt 172 extending through the first spring support member 156, the spring 160 and the second spring support member 158.

When assembling the container 10 with the lid assembly 12 of the present invention, the lid member 32 is positioned on the container 10 so that the roller assemblies 38 can freely travel along the travel path 74 defined on the recessed ledges 24 and 26. The tension on the springs of the adjustable spring assemblies 154 of the roller assemblies 38 are adjusted to insure that the roller assemblies 38 are sufficiently biased in the extended travel position to permit substantially unrestricted movement of the lid member 32 along the recessed ledges 24, 26 of the container 10.

The lid member 30 is then positioned on the lip portions 14, 16 of the container 10 and the roller assemblies 36 are adjusted to allow the lid member 30 substantially unrestricted movement along the lip portions 14, 16 of the container 10, while also permitting the lid member 32 to be telescopically disposed with the lid receiving cavity 60 of the lid member 30. Thereafter, the lid member 28 is positioned on the lip portions 14, 16 of the container 10 and the roller assemblies 34 adjusted, if necessary, to permit the roller assembly 28 to move in a substantially unrestricted manner along the lip portions 14, 16 of the container 10, while permitting the lid members 30 and 32 to be telescopically disposed within the lid receiving cavity 58 of the lid member 28.

The lid assembly 12 of the present invention is durable in construction and economical to manufacture. Only a minimum amount of clearance is required above the sludge container 10 when the lid assembly 12 of the present invention is utilized, and the lid assembly 12 of the present invention permits access to any portion of the sludge chamber 22 of the sludge container 10. Thus, it is clear that the present invention is well adapted to carry out the objects and obtain the ends and advantages mentioned herein as well as those inherent in the invention. While the presently preferred embodiment of the invention has been described for the purposes of this disclosure, numerous changes may be made which will readily suggest themselves to those skilled in the art and which are accomplished within the spirit of the invention disclosed and as defined in the appended claims.

What is claimed is:

1. An improved lid assembly for roll-off sludge containers having oppositely disposed lip portions extending longitudinally along each side of an opening formed in an upper side of the sludge container, the opening communicating with a sludge chamber, the improved lid assembly comprising:

a plurality of lid members supported on the lip portion of the sludge container so as to be selectively movable between a first position and a second position, in the first position one of the lid members being adapted to telescopingly receive the other lid members so as to provide access to the sludge chamber, in the second position the lid members cooperating to close off the opening in the sludge container;

roller means connected to each of the lid members for movement of the lid members between the first and second positions, the roller means of each lid member being laterally displaced relative to the roller means of the other lid members and selectively movable between an extended travel position and a retracted position, in the extended travel position the roller means biased so as to extend from the supporting lid members for travel along a travel path on the lip portion of the container as the lid member is selectively moved between the first and second positions, in the retracted position the roller means extending upwardly into the supporting lid members;

connector means for securing the lid members to the sludge container when the roller means are in the retracted position and the lid members are disposed in the second position; and gasket means supported by the lid members for forming a fluid-tight seal between the lid members and the sludge container when the lid members are secured in the second position.

2. The improved lid assembly of claim 1 wherein the roller means for each lid member comprises:

a plurality of spring-biased roller assemblies connected to the lid member and supported on the lip portions of the sludge container for movement along the travel path provided thereon.

3. The improved lid assembly of claim 2 wherein each of the lid members is provided with peripherally disposed sealing lips, and wherein the gasket means is supported on each of the sealing lips so as to extend downwardly therefrom such that the gasket means is sealingly disposed between the sealing lips of the lid member, the lip portions of the container and an underdisposed portion of the adjacent lid member when the spring-biased roller assemblies are in their retracted position and the lid members are secured in the second position.

4. The improved lid assembly of claim 2 wherein each of the spring-biased roller assemblies comprises:

at least one arm member pivotally connected to the lid member such that a distal end thereof extends away from the lid member in a downwardly extending direction;

a wheel member journally connected to the distal end portion of the arm member; and adjustable spring means for biasing the arm member and the wheel member downwardly so that the lid member is supported a selected distance from the lip portions of the container when the arm member and the wheel member are in the extended travel position and the connector means are disengaged therefrom.

5. The improved lid assembly of claim 4 wherein each of the lid members is provided with peripherally disposed sealing lips, and wherein the gasket means is supported on each of the sealing lips so as to extend downwardly therefrom such that the gasket means is disposed between the sealing lips of the lid member, the lip portions of the container and an under-disposed portion of an adjacent lid member when the arm member and the wheel member of each of the spring-biased roller assemblies are in the retracted position and the lid members are secured in the second position by the connector means.

6. The improved lid assembly of claim 5 wherein the adjustable spring means comprises:

a first spring support member connected to the arm member in close proximity to the wheel member;

a second spring support member connected to the lid member so as to be substantially vertically aligned with the first spring support member;

a spring disposed between the first and second spring support members; and adjustable connector means for interconnecting the first and second spring support members and the spring such that the tension of the spring can be adjusted in order to maintain the arm member and the wheel member in the extended travel position to enhance movement of the lid member between the first and second positions.

7. The improved lid assembly of claim 6 wherein the first and second spring support members are provided with a centrally disposed aperture, and wherein the adjustable connector means comprises:

a bolt having an enlarged head portion and a threaded shank portion, the enlarged head portion abuttingly engaging the second spring support member when the threaded shank portion is disposed through the apertures of the first and second spring support members and the spring supported therebetween; and a lock nut threadably engageable with the threaded shank portion of the bolt member so as to abuttingly engage the first spring support member.

8. An improved lid assembly for roll-off sludge containers having oppositely disposed lip portions extending longitudinally along each side of an opening formed in an upper side of the sludge container and communicating with a sludge chamber, each of the lip portions having a recessed ledge extending longitudinally along the opening so as to be adjacently disposed thereto, the improved lid assembly comprising:

a plurality of lid members, one of the lid members supported on the recessed ledges and the other lid member supported on the lip portions of the sludge container so as to be selectively movable between a first position and a second position, in the first position the lid members telescopingly disposed in one another so as to provide access to the sludge chamber, in the second position the lid members cooperating to close off the opening in the sludge container;

roller means connected to each of the lid members for movement of the lid members between the first and second positions, the roller means biased so as to be selectively movable between an extended travel position and a retracted position, in the extended travel position the roller means of one of the lid members adapted to travel along a travel path on the recessed ledges and the roller means of the other lid members adapted to travel along a travel path on the lip portions of the container as the lid members are selectively moved between the first and second positions, in the retracted position the roller means of each of the lid members being displaced upwardly into the supporting lid member, the roller means of each lid member being laterally displaced relative to the roller means of the other lid members;

connector means for securing the lid members to the sludge container when the roller means are in the retracted position and the lid members are disposed in the second position; and gasket means supported by the lid members for forming a fluid-tight seal between the lid members and the sludge container when the lid members are secured in the second position.

9. The improved lid assembly of claim 8 wherein the roller means for each lid member comprises:

a plurality of spring-biased roller assemblies connected to the lid member and supported on one of the recessed ledges and the lip portions of the sludge container for movement along the travel path provided thereon.

10. The improved lid assembly of claim 9 wherein each of the lid members is provided with peripherally disposed sealing lips, and wherein the gasket means is supported on each of the sealing lips so as to extend downwardly therefrom such that the gasket means is disposed between the sealing lips of the lid member, the lip portions of the container, and an under-disposed portion of an adjacent lid member when the lid members are secured to the container in the second position by the connector means.

11. The improved lid assembly of claim 9 wherein each of the spring-biased roller assemblies comprises:

a first arm member;

a parallel, spatially disposed second arm member, one end of each of the first and second arm members pivotally connected to the lid member such that distal ends thereof extend away from the lid member in a downwardly extending direction;

a wheel member disposed between the distal ends of the first and second arm members and journally connected thereto; and adjustable spring means for biasing the arm members downwardly so that the wheel member is supported a selected distance from the supporting lid member when the arm members and wheel member are disposed in the extended travel position and the connector means are disengaged from the lid members.

12. The improved lid assembly of claim 11 wherein each of the lid members is provided with peripherally disposed sealing lips, and wherein the gasket means is supported on each of the sealing lips so as to extend downwardly therefrom such that the gasket means is disposed between the sealing lips of the lid member, the lip portions of the container, and an under-disposed portion of an adjacent lid member when the arm member and the wheel member of each of the spring-biased roller assemblies are in the retracted position and the lid members are secured to the container in the second position by the connector means.

13. The improved lid assembly of claim 12 wherein the adjustable spring means comprises:

a first spring support member disposed between and connected to the arm members in close proximity to the wheel member;

a second spring support member connected to the lid member so as to be substantially vertically aligned with the first spring support member;

a spring disposed between and abuttingly engaging the first and second spring support members; and adjustable connector means for interconnecting the first and second spring support members and the spring such that the tension of the spring can be adjusted in order to maintain the arm members and the wheel member in the extended travel position to enhance movement of the lid member between the first and second positions.

14. The improved lid assembly of claim 13 wherein the first and second spring support members are provided with a centrally disposed aperture, and wherein the adjustable connector means comprises:

a bolt having an enlarged head portion and a threaded shank portion, the enlarged head portion abuttingly engaging the second spring support member when the threaded shank portion is disposed through the apertures of the first and second spring support members and the spring; and a lock nut threadably engageable with the threaded shank portion of the bolt member so as to abuttingly engage the first spring support member.

* * * * *